United States Patent [19]

Dunn et al.

[11] Patent Number: 4,948,522

[45] Date of Patent: Aug. 14, 1990

[54] DISPERSANT FOR MARINE DIESEL CYLINDER LUBRICANT

[75] Inventors: Adrian Dunn, Faringdon; Richard D. Kerwood, Didcot, both of United Kingdom

[73] Assignee: Exxon Chemical Patents Inc., Linden, N.J.

[21] Appl. No.: 313,750

[22] Filed: Feb. 22, 1989

[30] Foreign Application Priority Data

Feb. 23, 1988 [GB] United Kingdom ..... 8804171

[51] Int. Cl.[5] ..... C10M 141/10

[52] U.S. Cl. ..... 252/32.7 E; 252/33.3; 252/33.4; 252/37

[58] Field of Search ..... 252/32.7 E, 33.4, 37, 252/49.6, 33.8; 585/12

[56] References Cited

U.S. PATENT DOCUMENTS

| | | | |
|---|---|---|---|
| 2,084,501 | 6/1937 | Otto et al. | 196/151 |
| 3,254,025 | 5/1966 | LeSuer | 252/32.7 |
| 3,361,669 | 1/1968 | van Westen et al. | 252/40.7 |
| 3,852,204 | 12/1974 | Souillard et al. | 252/33.4 |
| 3,878,115 | 4/1975 | Souillard et al. | 252/33.4 |
| 4,375,418 | 3/1983 | Zoleski et al. | 252/33.4 |
| 4,420,407 | 12/1983 | Sung et al. | 252/33.4 |
| 4,767,551 | 8/1988 | Hunt et al. | 252/32.7 E |

FOREIGN PATENT DOCUMENTS

| | | |
|---|---|---|
| 0008193 | 6/1982 | European Pat. Off. . |
| 0096539 | 1/1988 | European Pat. Off. . |
| 57-185389 | 11/1982 | Japan . |
| 61-087792 | 5/1986 | Japan . |
| 61-166892 | 7/1986 | Japan . |
| 61-200199 | 9/1986 | Japan . |
| 1054310 | 1/1967 | United Kingdom . |

OTHER PUBLICATIONS

Souillard, George J., "The Use of Polybutenes in Lubrication", pp. 724–737, JSLE/ASLE International Lubricating Conference, Tokyo, Jun. 9–11, 1975.

*Primary Examiner*—Jacqueline V. Howard
*Attorney, Agent, or Firm*—J. B. Murray, Jr.

[57] ABSTRACT

A dispersant additive package for cylinder lubricant for marine diesel engines comprising a borated dispersant and a high molecular weight polybutene provides a lubricant with improved viscosity, wear, oxidation and deposit performance.

33 Claims, No Drawings

DISPERSANT FOR MARINE DIESEL CYLINDER LUBRICANT

This invention relates to an improved lubricating oil composition which is particularly useful as a lubricant in marine applications and particularly as a marine diesel cylinder lubricant (MDCL) for both crosshead engines and trunk piston engines. More particularly, this invention relates to a finished lubricant formulation exhibiting improved ring wear and liner wear performance, good protection against corrosion particularly at low working temperatures and good viscometric properties at high working temperatures.

The present invention is based upon the discovery that the incorporation into a marine diesel cylinder lubricant of a dispersant package comprising borated ashless dispersant such as a polyisobutenyl succinic anhydride-polyamine borated derivative and a polybutene, optionally in combination with a dithiophosphate anti-wear additive and/or an overbased metal detergent, results in the MDCL having surprising wear performance.

Borated dispersants are well-known additives in lubricants including compositions suitable for marine diesel lubricants. GB No. 1054310 and U.S. Pat. No. 3254025 describe nitrogen-and boron-containing compositions comprising borated dispersants such as polyisobutenyl succinic anhydride-polyamine borated derivatives and their use in gasoline and diesel engines including use in MDCL. The use of such borated dispersants in combination with zinc hydrocarbyl dithiophosphate (ZDDP) anti-wear additives and overbased metal detergents in general is disclosed, but there is no disclosure of a combination of borated dispersant and polybutene, with or without ZDDP and/or overbased metal detergent, in a formulation having the viscosity and total base number appropriate for MDCL.

EP 96539 describes a crankcase lubricant, as opposed to the MDCL of the present invention, which contains a borated PIBSA-polyamine dispersant, certain overbased metal detergents, ZDDP anti-wear agent, PIBSA and optionally a V.I. improver.

JP-A-61-166892 describes a lubricant for marine diesel engines comprising an ashless dispersant (but a borated dispersant is not described), a metal detergent, a dialkyl or diaryl dithiophosphate and oxygen-containing compound such as a glycol. There is no disclosure of a polybutene in these lubricants.

U.S. Pat. No. 44202407 describes an MDCL containing N-hydroxyethyl alkenylsuccinimide and an overbased calcium sulphonate but this lubricant contains no boron, no ZDDP or high molecular weight polybutene. Synthetic basestocks such as polypropylene and polyisobutylene of molecular weight between 250 and 2500 are disclosed.

Polybutenes are known additives in lubricants, being described for example in Proc. JSLE/ASLE Int. Lubr. Conf. Tokyo, June 9–11, 1975, pp 724–737 "The Use of Polybutenes in Lubrication" Georges J. Souillard, where it is stated that polybutenes which are oligomers with molecular weight between 300 and 3000 are used as synthetic oils, while very viscous derivatives having a molecular weight of 20000 to 100000 are used as V.I. improvers, with derivatives of higher molecular weight being synthetic rubbers.

EP-B-0008193 teaches that V.I. improvers are not normally required in marine diesel lubricants, but dispersants having V.I. properties such as polyalkylmethacrylates may be used.

JP-A-61-200199 describes a lubricant for the trial running of marine engines which uses polybutenes having a mean molecular weight of 300 to 1000 as basestock, optionally in mixtures with mineral oil.

JP-A-57-185389 describes lubricants for industrial plain bearings comprising a purified mineral oil having kinematic viscosity $K_\nu$(40° C.) of 10–10000 cSt and a viscosity index of at least 80 with 1 to 1000 ppm of oil-soluble polyisobutylene having at least 600000 weight average molecular weight, to give friction reduction.

JP-A-61-087792 describes a lubricant or hydraulic oil comprising base oil and 0.005 to 1.0 wt % of polyisobutylene with weight average molecular weight of at least 200000 as anti-leaking agent.

In accordance with the invention there is provided a dispersant additive package comprising an oil solution of:

(a) a borated ashless dispersant; and (b) a polybutene having a weight average molecular weight of greater than 100000.

The invention concerns the use of such a package in a cylinder lubricant for marine diesel engines having a total base number as measured by ASTM 2896 (TBN) of at least 20, and preferably at least 60, as well as improved cylinder lubricants containing such a package.

By the use of the dispersant additive package of the invention it is possible to increase the kinematic viscosity of the MDCL such that the $K_\nu$(100° C.) is greater than 18 cSt, preferably at least 19 cSt, and it is possible to obtain kinematic viscosity $K_\nu$(100° C.) of from 20 to 25 cSt. Moreover, it is possible to obtain improved viscometric performance such that the viscosity index or V.I. (as defined by ASTM D2270) is greater than 90 and more preferably 95 or greater. By achieving higher V.I. the kinematic viscosity at higher temperatures and particularly at the typical operating temperatures of MDCL is increased with reduction in wear. It is believed that the dispersant additive package of the invention enables $K_\nu$(200° C.) of 4 cSt or higher to be achieved.

The invention provides a method of improving the performance of cylinder lubricants for diesel engines, and particularly of increasing the viscosity and VI, by the addition of an appropriate amount of a dispersant additive package of the invention.

The amounts of borated ashless dispersant and polybutene in the package are not critical provided that the package can be formulated to form a cylinder lubricant for marine diesel engines containing an appropriate amount of each of these additives.

The package will generally contain (a) from 5 to 50 wt % of borated ashless dispersant;

(b) from 0.5 to 10 wt % of polybutene in oil solution.

When the package is used in a cylinder lubricant the latter preferably contains at least 0.1 wt % of the borated ashless dispersant, more preferably from 0.5 to 3.0 wt % of borated ashless dispersant, and at least 0.005 wt % of the polybutene, more preferably from 0.05 to 0.5 wt % of polybutene.

Thus, in a further aspect this invention provides a cylinder lubricant for marine diesel engines having a TBN of at least 20, preferably at least 70 and desirably from 70 to 90, which comprises:

(a) at least 0.1 wt %, preferably 0.5 to 3 wt %, of a borated ashless dispersant;

(b) at least 0.005 wt %, preferably 0.05 to 0.5 wt %, of a polybutene; and (c) at least 10 wt %, preferably 12.5 to 30 wt %, of one or more overbased metal detergents or a mixture thereof with neutral metal detergent, wherein the boron content of the composition is preferably at least 0.001 wt %, and most preferably 0.005 to 0.022 wt %.

The cylinder lubricant preferably also contains a zinc dihydrocarbyl dithiophosphate (ZDDP) as an anti-wear additive, preferably in an amount of at least 0.1% and most preferably 0.1 to 2.0 wt % ZDDP.

The cylinder lubricant preferably has a $K_v$(100° C.) greater than 8 cSt, V.I. greater than 90.

In use the package will be combined with lubricating oil basestock and sufficient of the overbased and/or neutral metal detergent to formulate such a lubricant.

The dispersant additive package of the invention may contain a part or all of the overbased metal detergent and/or neutral metal detergent and/or all or a part of the ZDDP required by the formulated cylinder lubricant, and thus in a preferred aspect the package contains (c) 0 to 50 wt % of one or more overbased metal detergents or a mixture thereof with neutral metal detergent; and/or (d) 0 to 10 wt % of ZDDP.

It has been found that using the preferred amounts of boron and zinc indicated provides a marine diesel cylinder lubricant exhibiting greatly improved wear performance and cleanliness.

There may also be present in a fully formulated cylinder lubricant small but effective amounts of other special purpose additives and these include anti-oxidants, anti-foamants, and rust inhibitors and additional surfactants.

The preferred borated ashless dispersants are the borated ashless hydrocarbyl succinimide dispersants prepared by reacting a hydrocarbyl succinic acid or anhydride with an amine. Preferred hydrocarbyl succinic acids or anhydrides are those where the hydrocarbyl group is derived from a polymer of a $C_3$ or $C_4$ monoolefin, especially a polyisobutylene wherein the polyisobutenyl group has a number average molecular weight (Mn) of from 700 to 5,000, more preferably from 900 to 2,500. Such dispersants generally have at least 1, preferably 1 to 2, more preferably 1.1 to 1.8, succinic groups for each polyisobutenyl group.

Preferred amines for reaction to form the succinimide are polyamines having from 2 to 60 carbon atoms and from 2 to 12 nitrogen atoms per molecule, and particularly preferred are the polyalkyleneamines represented by the formula $$NH_2(CH_2)_n—(NH(CH_2)_n)_m—NH_2$$

wherein n is 2 to 3 and m is 0 to 10. Illustrative are ethylene diamine, diethylene triamine, triethylene tetramine, tetraethylene pentamine, tetrapropylene pentamine, pentaethylene hexamine and the like, as well as the commercially available mixtures of such polyamines. Amines including other groups such as hydroxy, alkoxy, amide, nitride and imidazoline groups may also be used, as may polyoxyalkylene polyamines. The amines are reacted with the alkenyl succinic acid or anhydride in conventional ratios of about 1:1 to 10:1, preferably 1:1 to 3:1, moles of alkenyl succinic acid or anhydride to polyamine, and preferably in a ratio of about 1:1, typically by heating the reactants to from 100° to 250° C., preferably 125° to 175° C. for 1 to 10, preferably 2 to 6, hours.

The boration of alkenyl succinimide dispersants is also well known in the art as disclosed in U.S. Pat. Nos. 3 087 936 and 3 254 025. The succinimide may for example be treated with a boron compound selected from the group consisting of boron oxides, boron halides, boron acids and esters thereof, in an amount to provide from 0.1 atomic proportion of boron to 10 atomic proportions of boron for each atomic proportion of nitrogen in the dispersant.

The borated product will generally contain 0.1 to 2.0, preferably 0.2 to 0.8 weight per cent boron based upon the total weight of the borated dispersant. Boron is considered to be present as dehydrated boric acid polymers attaching at the metaborate salt of the imide. The boration reaction is readily carried out adding from 1 to 3 weight per cent (based on the weight of dispersant) of said boron compound, preferably boric acid, to the dispersant as a slurry in mineral oil and heating with stirring from 135° C. to 165° C. for 1 to 5 hours followed by nitrogen stripping filtration of the product. Alternatively boric acid may be added to the hot reaction mixture of succinic acid or anhydride and amine while removing water.

The polybutenes used in the invention may be polyisobutenes (PIB) or poly-n-butenes (PNB) or mixtures of the two. Such polybutenes are prepared by polymerization of suitable butene feedstocks by techniques well known in the art using catalysts such as aluminium chloride and boron trifluoride. Preferred polybutenes for use in the invention have a weight average molecular weight of greater than 200000, more preferably greater than 500000. Most preferably polybutenes of weight average molecular weight of 400000 to 3000000 are employed.

Weight average molecular weight (Mw) may be obtained from experimental determinations of molecular weight which depend on the weight of material of different molecular weights. Gel permeation chromatography (GPC) may be used to measure Mw, and ASTM 3593-80 describes a standard method using readily available polystyrene calibration standards.

It is possible to use a mixture of polybutenes of different molecular weights and/or to use techniques such as mastication and/or homogenization to break down polymer molecules, and such techniques will give a broader molecular weight distribution (usually measured as weight average to number average (Mn) ratio—i.e. Mw/Mn). Preferably the ratio Mw/Mn for polybutenes, and particularly polyisobutenes, will be from 1.3 to 5.

Mn may be measured directly from colligative properties such as osmotic pressure, and vapour phase osmometry (VPO) is often used. However, GPC with proper calibration as described above, permits determination of Mn and Mw/Mn values as described in ASTM 3593-80.

The metal detergent additives suitable in the diesel oil formulations of the present invention are known in the art and include alkali metal and alkaline earth metal additives such as overbased oil-soluble calcium, magnesium, sodium and barium salts such as phenates, sulphurised phenates, sulphonates, salicylates and naphthenates, wherein the overbasing is an oil-insoluble salt of the metal, e.g., carbonate, basic carbonate, acetate, formate, hydroxide or oxalate, which is stabilised by the oil-soluble salt. The overbased calcium sulphurised phenates obtained from $C_9$ or $C_{12}$ alkyl phenols and sulphonates of $C_{16}$–$C_{50}$ alkyl- substituted benzene or toluene sulphonic acids which have a TBN of from 200 to 500, typically 300 to 400 are preferred.

Highly basic alkali metal and alkaline earth metal sulphonates are frequently used as detergents. They are usually produced by heating a mixture comprising an oil-soluble sulphonate or alkaryl sulphonic acid, with an excess of alkali metal or alkaline earth metal compound above that required for complete neutralization of any sulphonic acid present and thereafter forming a dispersed carbonate complex by reacting the excess metal with carbon dioxide to provide the desired overbasing. The sulphonic acids are typically obtained by the sulphonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. As indicated above, the preferred alkaryl sulphonates for use in the invention contain from 16 to 50 carbon atoms per alkyl substituent on a benzene or toluene moiety.

The alkaline earth metal compounds which may be used in neutralizing these alkaryl sulphonic acids to provide the sulphonates includes the oxides and hydroxides, alkoxides, carbonates, carboxylate, sulphide, hydrosulphide, nitrate, borates and ethers of magnesium, calcium, and barium. Examples are calcium oxide, calcium hydroxide, magnesium acetate and magnesium borate. Sodium is the preferred alkali metal although lithium and potassium may be used. As noted, the alkali metal or alkaline earth metal compound is used in excess of that required to complete neutralization of the alkaryl sulphonic acids. Generally, the amount ranges from 100 to 220%, although it is preferred to use at least 125%, of the stoichiometric amount of metal required for complete neutralization.

Various other preparations of basic alkaline earth metal alkaryl sulphonates are known, such as U.S. Pat. Nos. 3 150 088 and 3 150 089 wherein overbasing is accomplished by hydrolysis of an alkoxide-carbonate complex with the alkaryl sulphonate in a hydrocarbon solvent-diluent oil.

The sulphurized metal phenates can be considered the "metal salt of a phenol sulphide" which thus refers to a metal salt whether neutral or basic, of a compound typified by the general formula:

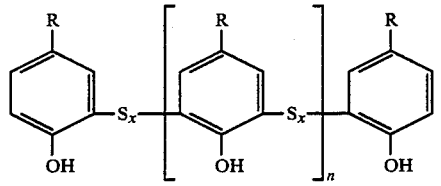

where x=1 or 2, n=0, 1 or 2 or a polymeric form of such a compound, where R is an alkyl radical, n and x are each integers from 1 to 4, and the average number of carbon atoms in all of the R groups is at least about 9 in order to ensure adequate solubility in oil. The individual R groups may each contain from 5 to 40, but as indicated above preferably contain from 9 to 12 carbon atoms.

The metal salt is prepared by reacting an alkyl phenol sulphide with a sufficient quantity of metal containing material to impart the desired alkalinity to the sulphurized metal phenate.

Regardless of the manner in which they are prepared, the sulphurized alkyl phenols which are useful generally contain from 2 to 14% by weight, preferably 4 to 12 wt. % sulphur based on the weight of sulphurized alkyl phenol.

The sulphurized alkyl phenol may be converted by reaction with a metal containing material including oxides, hydroxides and complexes in an amount sufficient to neutralize said phenol and, if desired, to overbase the product to a desired alkalinity by procedures well known in the art. Preferred is a process of neutralization utilizing a solution of metal in a glycol ether.

The neutral or normal sulphurized metal phenates are those in which the ratio of metal to phenol nucleus is about 1:2. The "overbased" or "basic sulphurized metal phenates" are sulphurized metal phenates wherein the ratio of metal to phenol is greater than that of stoichiometric, e.g. basic sulphurized metal dodecyl phenate has a metal content up to and greater than 100% in excess of the metal present in the corresponding normal sulphurized metal phenates wherein the excess metal is produced in oil-soluble or dispersible form (as by reaction with $CO_2$).

These overbased materials may be used as the sole metal detergent additive or in combination with the same additives in the neutral form but the overall metal detergent additive combination should have the same basicity as represented by the foregoing total base number. Preferably they are present in amounts of from 12.5 to 15 wt % with the aforementioned mixture of overbased calcium sulphurised phenate and calcium sulphonate being especially useful. The weight ratio of sulphonate to phenate is desirably from 1:1 to 15:1, preferably from 5:1 to 15:1, typically from 9:1 to 12:1.

The ZDDP or zinc dihydrocarbyl dithiophosphate salts used as anti-wear agents, and also to provide antioxidant activity, may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols may be used including mixtures of primary and secondary alcohols, secondary generally for imparting improved anti-wear properties, with primary giving improved thermal stability properties. Mixtures of the two are particularly useful. In general, any basic or neutral zinc compound could be used by the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates for use in the present invention are oil soluble salts of dialkyl esters of dithiophosphoric acids represented by the formula: $[RO(R'O)PS_2]_2Zn$ wherein R and R'may be the same or different alkyl radicals preferably containing 3 to 10, more preferably 3 to 8 carbon atoms and including n-propyl, i-propyl, n-butyl, i-butyl, sec-butyl, amyl, n-hexyl, i-hexyl, n-octyl, 2-ethylhexyl, cyclohexyl and methylcyclopentyl groups.

A wide variety of lubricating oil basestocks may be used in preparing the packages and cylinder lubricant compositions of this invention including mineral oils and synthetic oils. However, the basestock employed in the cylinder lubricant is typically a parafinic mineral oil having a viscosity of about 2–40 centistokes (ASTM-D-445) at 99° C. are employed preferably to give a finished lubricant with a viscosity meeting the requirements of SAE 50. It is an advantage of the invention that excellent viscosity index and kinematic viscosity performance can be obtained without having to resort to special, and expensive refined basestocks or "brightstock".

The invention is further illustrated by the following examples which are not to be considered as limitative of its scope. Percentages are by weight except where otherwise indicated.

In these Examples various formulations were prepared according to the invention. The following parameters were measured and the described tests were carried out.

| | | |
|---|---|---|
| $K_\nu$(100° C.) = | Kinematic viscosity at 100° C. | |
| V.I. = | Viscosity Index | ASTM D2270 |
| TBN = | Total Base Number | ASTM 2896 |

PANEL COKER TEST

A rectangular Aluminium plate (35 mm * 85 mm * 6 mm) is ground so that the surface finish on the two faces is 25 microns (centre line average). After cleaning and drying the plate using heptane it is then weighed before being clamped in an inclined position above a sump containing 250 g of test oil.

Running through the sump is a shaft with several short wires protruding, this shaft is driven by an electric motor and oil is flicked onto the test plate by the short wires. The conditions used were:

Sump at ambient temperature,

Test plate at 322.2° C.,

Motor on for 15 seconds in every 60 seconds, and

Test duration 2 hours.

At the end of the test period the plate is cooled then cleaned of oil and dried. When thoroughly clean and dry the plate is weighed again and the weight of deposit is recorded in milligrams. The test gives an indication of the thermal stability of the oil and its likely cleanliness in the engine.

DIFFERENTIAL SCANNING CALORIMETER (DSC)

This test is used to measure the oils potential to oxidise at high temperature. A sample of the test oil is run against a reference in a standard DSC set up. The reference and the sample are heated in air at a pressure of 6.9 bar, the temperature being increased at a rate of 10° C./min. starting at 100° C. up to 450° C. The heat evolution is measured and the oxidation temperature of the test sample is that at which the heat evolution deviates from the reference. Also the amount of oxidation of the test sample that has occurred when the sample has reached 230° C. is calculated from heat evolution up to that temperature and expressed as a percent of the total heat evolved.

HEAVY FUEL CATERPILLAR ENGINE TEST (HF Cat)

This single cylinder engine test uses a Caterpillar engine (arrangement 1Y73 supercharged) modified to run on heavy fuel oil. The test determines the effect of the test oil or ring sticking, wear and accumulation of deposits, under high speed, supercharged conditions. The test is carried out on samples diluted to 30TBN with additional basestock to enable the test to discriminate better between oils.

At the end of a 200 hour test period the engine is stripped down and the piston is rated for cleanliness. A Weighted Total Demerit (WTD) is determined and the lower the value the better. Top Groove Fill (TGF) is also measured and again the lower the value the better.

WEAR RIG

The purpose of this test is to examine the ability of the test oil to control wear between two metal surfaces at high loads. The test consists of a cast iron flat test piece which is set in motion by a reciprocating drive connected to an electric motor. The flat test piece is submerged in a bath of the test oil which can be heated to various temperatures. A specially ground test pin is set to rest against the flat and then a load is applied to the arm holding the test pin. The combined wear of both pin and flat are measured throughout the test period of 4 hours together with the friction force. An average wear and friction figure is calculated after each hour in addition to an overall wear figure. Test conditions are 80° C., 120 kg load, and 4 hours.

Examples 1–3 and Comparative Examples 4–6

Additive concentrates were prepared by blending dispersant, overbased metal additives, and ZDDP antiwear additives at 65° C. to form a homogeneous solution. These concentrates were diluted with different mineral oils, with and without polybutenes to provide the finished lubricant compositions of the Examples and Comparative Examples, as shown in Table 1 attached.

TABLE 1

| Example no: | 1 | 2 | 3 | 4 | 5 | 6 |
|---|---|---|---|---|---|---|
| Overbased Ca sulphonate[1] (%) | 13.77 | 13.77 | 13.77 | 13.77 | 13.77 | 13.77 |
| Overbased Ca Phenate[2] (%) | 1.36 | 1.36 | 1.36 | 1.36 | 1.36 | 1.36 |
| ZDDP[3] (%) | 0.30 | 0.30 | 0.30 | 0.30 | 0.30 | 0.30 |
| Borated PIBSA-PAM[4] (%) | 2.38 | 2.38 | 2.38 | 2.38 | 2.38 | 2.38 |
| Diluent[5] (%) | 19.95 | 20.89 | 21.83 | 16.19 | 16.19 | 16.19 |
| Basestock[6] (%) | 62.00 | 61.00 | 60.00 | 40.00 | 38.00 | 36.00 |
| Brightstock[7] (%) | — | — | — | 26.00 | 28.00 | 30.00 |
| Polybutene[8] (%) | 0.24 | 0.30 | 0.36 | — | — | — |
| Boron (%) | 0.017 | 0.017 | 0.017 | 0.017 | 0.017 | 0.017 |
| Zinc (%) | 0.03 | 0.03 | 0.03 | 0.03 | 0.03 | 0.03 |
| TBN | 87.2 | 87.9 | 87.2 | 87.5 | 88.0 | 87.8 |
| $K_\nu$(100° C.) | 24.0 | 25.6 | 27.7 | 24.3 | 25.0 | 25.6 |
| V.I. | 121 | 125 | 129 | 104 | 104 | 100 |

[1]300 TBN calcium sulphonate
[2]250 TBN calcium sulphurized phenate
[3]Zinc dioctyl dithiophosphate
[4]Borated polyisobutenyl succinic anyhydride-polyamine reaction product
[5]Diluent oil introduced as solvent for other additives
[6]Conventional mineral oil basestock
[7]Brightstock: high viscosity oil, highly refined and dewaxed, produced from residual stocks or bottoms.
[8]PIB: $M_w$ = 847000, $M_w/M_n$ = 3.44, measured by GPC with a polystyrene standard.

The formulations show that large amounts of expensive brightstock are needed to achieve small increases in $K_\nu$(100° C.) and even at these levels the beneficial effect on V.I. is smaller than is achieved with relatively small amounts of polybutene according to the invention.

These formulations were tested in DSC and panel coker tests, as defined above, and the results are set out in Table 2 attached.

TABLE 2

| Example No. | 1 | 2 | 3 | 4 | 5 | 6 |
|---|---|---|---|---|---|---|
| Panel coker (mg) | 3.7 | 9.4 | 5.8 | 10.0 | 22.9 | 10.2 |
| DSC (% × 230° C.) | 0.60 | 0.32 | 0.49 | 0.08 | 0.22 | 0.56 |

These results show that even at the very low levels of polybutene according to the invention reduced levels of deposits are seen in the Panel Coker test as compared to those obtained from comparative formulations.

Examples 7 and 8 and Comparative Examples 9–13

Further formulations containing polybutene according to the invention were prepared and compared to similar formulations containing no polybutene, and to formulations containing a low molecular weight PIB. A further comparison was provided with formulations containing no boron.

The formulations prepared were as shown in Table 3 attached.

TABLE 3

| | Example No. | | | | | | |
|---|---|---|---|---|---|---|---|
| | 7 | 8 | 9 | 10 | 11 | 12 | 13 |
| Overbased Ca sulphonate[1] | 11.34 | 11.22 | 11.34 | 11.34 | 11.34 | 11.34 | 11.22 |
| Overbased Ca phenate[2] | 1.12 | 1.95 | 1.12 | 1.12 | 1.12 | 1.12 | 1.95 |
| ZDDP[3] | 0.25 | 0.25 | 0.25 | 0.25 | 0.25 | 0.25 | 0.25 |
| Borated PIBSA-PAM[4] | 1.96 | 1.94 | — | 1.96 | 1.96 | — | 1.96 |
| PIBSA-PAM[9] | — | — | 1.69 | — | — | 1.69 | — |
| Diluent[5] | 18.97 | 15.54 | 19.24 | 13.33 | 13.33 | 13.60 | 14.13 |
| Basestock[6] | 62.00 | 59.01 | 62.00 | 62.00 | 62.00 | 63.00 | 53.31 |
| Brightstock[7] | 4.00 | 10.00 | 4.00 | 10.00 | 1.00 | — | 17.20 |
| Polybutene[8] | 0.36 | 0.09 | 0.36 | — | — | — | — |
| 900$M_n$ PIB | — | — | — | — | 9.00 | 9.00 | — |
| Boron (%) | 0.014 | 0.014 | 0 | 0.014 | 0.30 | 0 | 0.014 |
| Zinc (%) | 0.02 | 0.02 | 0.02 | 0.02 | 0.02 | 0.02 | 0.02 |
| TBN[10] | 70 | 70 | 70 | 70 | 70 | 70 | 70 |
| $K_v$(100° C.) | 26.77 | 19.80 | 28.99 | 18.64 | 21.34 | 23.45 | 19.43 |
| V.I. | | 116 | 133 | | | 108 | 111 |

[1,2,3,4,5,6,7,8]see Table I
[9]Non-borated version of the borated PIBSA-PAM
[10]Nominal value.

These formulations were subject to DSC oxidation, Panel Coker, Wear Rig and HF CAT tests as defined above and the results are shown in Table 4 attached.

TABLE 4

| Example No. | 7 | 8 | 9 | 10 | 11 | 12 | 13 |
|---|---|---|---|---|---|---|---|
| DSC (% oxidation at 230° C.) | 0.48 | 3.37 | 2.55 | 0.66 | 0.61 | 5.27 | 4.57 |
| Panel coker (mg) | 0.3 | 12.2 | 4.1 | 19.2 | 56.8 | 66.6 | 6.1 |
| Wear rig (mm/1000 hr) | 2.33 | 3.33 | 4.33 | 2.16 | 2.75 | 4.17 | 6.0 |
| HF CAT | | | | | | | |
| (WTD) | — | 144 | — | — | — | — | 522 |
| (TGF %) | — | 48 | — | — | — | — | 89 |

These results show that Example 7 of the invention gives excellent wear results, resistance to oxidation and low deposits. In comparison Example 9 shows that in the absence of boron the MDCL shows more oxidation, wear and deposits. Examples 10, 11 and 12 show that in the absence of high molecular weight polybutene deposits are much higher and oxidation is somewhat greater, particularly when boron is also absent. The presence of low molecular weight PIB gives no benefit, save for a small improvement in wear in the formulation containing no boron which is in any event significantly worse than Example 7. Comparing Examples 7 and 8 indicates that the formulation containing a higher level of phenate performs less well in the DSC, Panel Coker and Wear Rig tests, but comparison with Example 13 shows that, with the exception of the Panel Coker test, the presence of polybutene has a beneficial effect. This beneficial effect is particularly marked in the HF CAT test where a significant credit is seen in top groove fill (TGF) and weighted total demerits (WTD).

Examples 14–16

The cylinder lubricant compositions of the invention of Examples 1–3, 7 and 8 may be formulated from a dispersant additive package comprising the dispersant and polybutene as shown in Table 5 which are Examples of packages of the invention. These packages are combined with metal detergents, other components as required, and basestock to prepare the cylinder lubricant compositions of the invention.

TABLE 5

| Package Ex. No. | 14 | 15 | 16 | 17 | 18 |
|---|---|---|---|---|---|
| Used in preparing MDCL Ex. No. | 1 | 2 | 3 | 7 | 8 |
| Borated PIBSA-PAM | 26.45 | 23.80 | 21.64 | 19.6 | 35.28 |
| Polybutene | 2.67 | 3.00 | 3.37 | 3.6 | 1.64 |
| Diluent | 70.88 | 73.20 | 75.09 | 76.8 | 63.08 |

We claim:

1. A cylinder lubricant composition for marine diesel engines comprising a major amount of an oil of lubricating viscosity and
   (a) at least 0.1 wt % of a borated ashless dispersant;
   (b) at least 10 wt % of one or more overbased metal compounds; and
   (c) at least 0.005 wt % of a polybutene having a weight average molecular weight of greater than 100,000 wherein the boron content of the cylinder lubricant composition is from 0.001 wt %, and the TBN is at least 20.

2. The composition of claim 1, wherein the composition comprises an SAE 50 lubricant.

3. The composition of claim 1 which contains from 0.5 to 3 wt % of the borated dispersant.

4. The composition of claim 1 wherein the dispersant is a borated polyisobutenyl succinic anhydride polyalkylene amine reaction product, the polyisobutenyl moiety having a Mn of from 900 to 2,500.

5. The composition of claim 1 which contains from 12.5 to 30 wt % of overbased metal compound.

6. The composition of claim 5, in which the overbased metal compound is a mixture of overbased calcium sulphonate and overbased calcium sulphurised phenate.

7. The composition of claim 6, in which the weight ratio of sulphonate to phenate is from 1:1 to 15:1.

8. The composition of claim 1 which contains 0.05 to 0.5 wt % of the polybutene.

9. The composition of claim 1 in which the polybutene has a weight average molecular weight of 400,000 to 3,000,000.

10. A composition of claim 1 in which the polybutene is characterized by a Mw/Mn ratio of from 1.3 to 5.

11. The composition of claim 1 wherein there is present at least 0.1 wt. % of a zinc dihydrocarbyl dithiophosphate.

12. The composition of claim 11, wherein the zinc dihydrocarbyl dithiophospate is a zinc dialkyl dithiophosphate wherein the alkyl group has from 3–9 carbon atoms.

13. The composition of claim 1 which has a boron content of from 0.001 to 0.022 wt. %.

14. The composition of claim 13 which has a boron content of from 0.005 to 0.022 wt %.

15. The composition of claim 1 having a TBN of at least 60.

16. The composition of claim 1 having a kinematic viscosity $K_v$(100° C.) of greater than 18 cSt.

17. The composition of claim 16, wherein the $K_v$(100° C.) is at least 19 cSt.

18. The composition of claim 1 having a viscosity index of greater than 90.

19. The composition of claim 1 having a kinematic viscosity $K_v$(100° C.) of at least 4 cSt.

20. The method of formulating a cylinder lubricant for marine diesel engines, the lubricant having a TBN of at least 20, in which a dispersant additive package comprising:

(a) a borated ashless dispersant; and (b) a polybutene having a weight average molecular weight of greater than 100,000, and one or more overbased metal detergents or a mixture thereof with neutral metal detergent are combined with a lubricating oil basestock to form the lubricant.

21. The method as claimed in claim 20 in which at least a part of the said metal detergents or the said miXture thereof with neutral metal detergent forms part of the said package.

22. The method as claimed in claim 21 in which the package further comprises zinc dihydrocarbyl dithiophosphate.

23. The method as claimed in claim 20 wherein the package comprises:

(a) from 5 to 50 wt. of borated ashless dispersant;

(b) from 0.5 to 10 wt. of polybutene;

(c) from 0 to 50 wt. of overbased metal detergent; and (d) from 0 to 10 wt. of zinc dihydrocarbyl dithiophosphate.

24. A method of improving the viscosity characteristics of a cylinder lubricant for marine diesel engines by adding thereto a dispersant additive package comprising:

(a) a borated ashless dispersant; and (b) a polybutylene having a weight average molecular weight of greater than 100,000 in an amount such that the $K_v$(100° C.) of the lubricant is greater than 18 cSt and the viscosity index is greater than 90.

25. A cylinder lubricant composition for marine diesel engines comprising a major amount of an oil of lubricating viscosity and (a) from 0.5 to 3 wt. % of a borated ashless dispersant;

(b) from 12.5 to 30 wt. % of one or more overbased metal compounds; and (c) from 0.05 to 0.5 wt. % of a polybutene having a weight average molecular weight of greater than 100,000 wherein the boron content of the cylinder lubricant composition is from 0.01 to 0.22 wt. %, and wherein the TBN of the cylinder lubricant composition is from 70 to 90.

26. The composition of claim 1, wherein the dispersant comprises a borated polyisobutenyl succinic anhydride polyalkaline amine reaction product, the polyisobutenyl moiety having a number average molecular weight of from 900 to 2,500.

27. The composition of claim 25, wherein the overbased metal compound comprises a mixture of overbased calcium sulphurized phenate.

28. The composition of claim 27, in which the weight ratio of sulphonate to phenate is from 1:1 to 15:1.

29. The composition according to claim 25, wherein the polybutene has a weight average molecular weight of from 400,000 to 300,000.

30. The composition of claim 25, wherein the polybutene is characterized by a Mw/Mn ratio of from 1.3 to 5.

31. The composition of claim 25, wherein there is also present in the composition at least 0.1 wt. % of a zinc dialkyl dithiophosphate wherein the alkyl group has from 3 to 9 carbon atoms.

32. The composition according to claim 31, wherein the zinc dialkyl dithiophosphate is present in a concentration of from 0.1 to 2.0 wt. % in the composition.

33. The composition according to claim 25, wherein the kinematic viscosity $K_v$ (100° C.) is from 20 to 25 cSt.

* * * * *